US005243392A

United States Patent [19]

Berkes et al.

[11] Patent Number: 5,243,392

[45] Date of Patent: Sep. 7, 1993

[54] IMAGING APPARATUS AND PROCESS WITH INTERMEDIATE TRANSFER ELEMENT

[75] Inventors: John S. Berkes, Webster; Frank J. Bonsignore, Rochester; Joseph Mammino, Penfield; Dennis A. Abramsohn, Pittsford; Donald S. Sypula, Penfield, all of N.Y.

[73] Assignee: Xerox Corporation, Stamford, Conn.

[21] Appl. No.: 844,959

[22] Filed: Feb. 28, 1992

Related U.S. Application Data

[63] Continuation of Ser. No. 513,408, Apr. 23, 1990, abandoned.

[51] Int. Cl.[5] ..... G03G 15/16

[52] U.S. Cl. ..... 355/275; 430/126

[58] Field of Search ..... 355/271, 272, 273, 274, 355/275, 277, 281; 430/48, 126

[56] References Cited

U.S. PATENT DOCUMENTS

| | | | |
|---|---|---|---|
| 2,885,955 | 5/1955 | Vyerberg | 355/277 |
| 3,526,191 | 9/1960 | Silverberg et al. | 355/272 X |
| 3,537,786 | 10/1966 | Schlein et al. | 355/220 |
| 3,765,330 | 10/1973 | Gundlach | 355/211 |
| 3,781,105 | 12/1973 | Meagher | 355/274 |
| 3,804,511 | 4/1974 | Rait et al. | 355/272 X |
| 3,862,848 | 1/1975 | Marley | 355/275 X |
| 3,893,761 | 7/1975 | Buchan et al. | 355/272 |
| 3,920,325 | 11/1975 | Swift | 355/274 X |
| 3,957,367 | 5/1976 | Goel | 355/281 |
| 3,993,484 | 11/1976 | Rait et al. | 355/272 X |
| 4,014,605 | 3/1977 | Fletcher | 355/273 |
| 4,023,894 | 5/1977 | Goel | 355/274 X |
| 4,232,961 | 11/1980 | Masuda | 355/271 |
| 4,275,134 | 6/1981 | Knechtel | 430/44 |
| 4,341,455 | 7/1982 | Fedder | 355/274 |
| 4,395,109 | 7/1983 | Nakajima et al. | 355/289 X |
| 4,600,539 | 9/1986 | Radulski et al. | 355/272 |
| 4,606,955 | 8/1986 | Eastman et al. | 428/36 |
| 4,674,860 | 6/1989 | Tokunaga et al. | 355/274 |
| 4,682,880 | 7/1989 | Fujii et al. | 355/327 |
| 4,931,839 | 6/1990 | Tompkins et al. | 355/277 |

FOREIGN PATENT DOCUMENTS

| | | |
|---|---|---|
| 0332223 | 3/1989 | European Pat. Off. . |
| 62-159164 | 7/1987 | Japan . |
| 62-191863 | 8/1987 | Japan . |
| 0311263 | 12/1988 | Japan . |
| 2081646 | 7/1981 | United Kingdom . |

OTHER PUBLICATIONS

Fink et al., Standard Handbook for Electrical Engineers, 1978, Tables 4–67, 4–75.

Hayt, Jr., Engineering Electromagnetics, pp. 149 and 508, 1981.

Hudson et al., University Physics, p. 586, 1982.

Xerox Disclosure Journal, "Color Xerography with Intermediate Transfer", J. R. Davidson, vol. 1, No. 7, Jul. 1976, p. 29.

*Primary Examiner*—A. T. Grimley
*Assistant Examiner*—Robert Beatty
*Attorney, Agent, or Firm*—Judith L. Byorick

[57] ABSTRACT

An imaging apparatus comprises an imaging member, a means for generating an electrostatic latent image on the imaging member, a means for developing the latent image, an intermediate transfer element having a charge relaxation time from about $3\times10^{-1}$ seconds to about $2\times10^{2}$ seconds to which the developed image can be transferred from the imaging member, and a means for transferring the developed image from the intermediate transfer element to a substrate. Also disclosed is an imaging process which comprises generating an electrostatic latent image on an imaging member, developing the latent image, transferring the developed image to an intermediate transfer element having a change relaxation time from about $3\times10^{-1}$ seconds to about $2\times10^{2}$ seconds, which enables the transfer with very high transfer efficiency of the developed image from the intermediate transfer element to substrate.

30 Claims, 1 Drawing Sheet

IMAGING APPARATUS AND PROCESS WITH INTERMEDIATE TRANSFER ELEMENT

This is a continuation of application Ser. No. 07/513,408, filed Apr. 23, 1990, now abandoned.

BACKGROUND OF THE INVENTION

The present invention is directed to an imaging apparatus and process. More specifically, the present invention is directed to an imaging apparatus and process wherein an electrostatic latent image is formed on an imaging member and developed with a toner, followed by transfer of the developed image to an intermediate transfer element and subsequent transfer with very high transfer efficiency of the developed image from the intermediate transfer element to a permanent substrate, wherein the intermediate transfer element has a charge relaxation time of no more than about $2\times10^2$ seconds.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Other methods for forming latent images are also known, such as ionographic methods. In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Imaging processes wherein a developed image is first transferred to an intermediate transfer means and subsequently transferred from the intermediate transfer means to a substrate are known. For example, U.S. Pat. No. 3,862,848 (Marley), the disclosure of which is totally incorporated herein by reference, discloses an electrostatic method for the reproduction of printed matter in which an electrostatic latent image is developed by the attraction of electroscopic marking particles thereto and is then transferred to a first receptor surface by the simultaneous application of contact and a directional electrostatic field of a polarity to urge the marking particles to the receptor surface, with the image then being transferred from the first receptor surface to a second receptor surface by the simultaneous application of contact and a directional electrostatic field of opposite polarity to urge the marking particles to the second receptor surface.

In addition, U.S. Pat. No. 3,957,367 (Goel), the disclosure of which is totally incorporated herein by reference, discloses a color electrostatographic printing machine in which successive single color powder images are transferred, in superimposed registration with one another, to an intermediary. The multi-layered powder image is fused on the intermediary and transferred therefrom to a sheet of support material, forming a copy of the original document.

Further, U.S. Pat. No. 4,341,455 (Fedder), the disclosure of which is totally incorporated herein by reference, discloses an apparatus for transferring magnetic and conducting toner from a dielectric surface to plain paper by interposing a dielectric belt mechanism between the dielectric surface of an imaging drum and a plain paper substrate such that the toner is first transferred to the dielectric belt and subsequently transferred to a plain paper in a fusing station. The dielectric belt is preferably a material such as Teflon or polyethylene to which toner particles will not stick as they are fused in the heat-fuser station.

Additionally, U.S. Pat. No. 3,537,786 (Schlein et al.), the disclosure of which is totally incorporated herein by reference, discloses a copying machine using a material capable of being persistently internally polarized as the latent image storage means. A removable insulative carrier is applied to the storage means and receives a toner which clings to the carrier in correspondence with a previously applied image pattern. The carrier is then removed from contact with the storage means and forms a record of the recorded image. In one embodiment, the insulative carrier is then passed over a heater to fix the toner so that the insulative carrier forms the final image bearing means. In an alternative embodiment, the insulative carrier bearing the toner is brought into contact with a separate image bearing medium so as to transfer the toner to this image bearing medium which then acts as the final image bearing means. The insulative carrier can be of a material such as polyethylene, polypropylene, polyethylene glycol terephthalate (Mylar®), polyeterafluoroethylene (Teflon®), polyvinylidene-acrylonitrile copolymers (Saran®), cellulose nitrate, cellulose acetate, acrylonitrile-butadiene-styrene terpolymers, cyclicized rubbers, and similar irradiation transparent, essentially non-photopolarizable organic or inorganic materials having a volume resistivity greater than $10^9$ ohm-cm.

U.S. Pat. No. 3,893,761 (Buchan et al.), the disclosure of which is totally incorporated herein by reference, discloses an apparatus for transferring non-fused xerographic toner images from a first support material, such as a photoconductive insulating surface, to a second support material, such as paper, and fusing the toner images to the second support material. Such apparatus includes an intermediate transfer member having a smooth surface of low surface free energy below 40 dynes per centimeter and a hardness of from 3 to 70 durometers. The intermediate transfer member can be, for example, a 0.1 to 10 mil layer of silicone rubber or a fluoroelastomer coated onto a polyimide support. The member can be formed into belt or drum configuration. Toner images are transferred from the first support material to the intermediate transfer member by any conventional method, preferably pressure transfer. The toner image is then heated on the intermediate transfer member to at least its melting point temperature, with heating preferably being selective. After the toner is heated, the second support material is brought into pressure contact with the hot toner whereby the toner is transferred and fused to the second support material.

In addition, U.S. Pat. No. 4,275,134 (Knechtel), the disclosure of which is totally incorporated herein by reference, discloses an electrophotographic process using a photosensitive medium having an insulating layer on a photoconductive layer, the surface of the photosensitive medium being uniformly charged with a primary charge. The primary-charged surface of the photosensitive medium is then charged with a charge of the opposite polarity or discharged and simultaneously therewith or therebefore or thereafter, exposed to image light from an original. A grid image is projected upon the surface of the suface of the photosensitive medium. For multi-color representation, the steps can be repeated in accordance with the number of colors desired. In this instance, the color images are transferred onto an intermediate drum which can be, for example, coated with a layer of Teflon®.

Further, U.S. Pat. No. 4,682,880 (Fujii et al.), the disclosure of which is totally incorporated herein by reference, discloses a process wherein an electrostatic latent image is formed on a rotatable latent image bearing member and is developed with a developer into a visualized image. The visualized image is transferred by pressure to a rotatable visualized image bearing member. The steps are repeated with different color developers to form on the same visualized image bearing member a multi-color image which corresponds to one final image to be recorded. The latent image bearing member and the visualized image bearing member form a nip therebetween through whcih a recording material is passed so that the multi-color image is transferred all at once to a recording material.

U.S. Pat. No. 2,885,955 (Vyverberg) discloses an apparatus for printing on print-receiving material of a type liable to dimensional change or change in other physical characteristics when subjected to xerographic heat or vapor fixing techniques. The apparatus contains a rotatable xerographic cylinder having an image forming surface with a photoconductive layer and a means for rotating the cylinder through a predetermined path of movement relative to a plurality of xerographic processing stations, including a charging station for applying electric charge to the photoconductive layer, an exposure station with a projection means for projecting a light image onto the charge photoconductive layer to form an electrostatic latent image, and a developing station having a means for depositing powdered developing material on the photoconductive layer to develop the latent image. In addition, the apparatus contains a means for supporting a web of water receptive planographic printing material, a means for moving the web in surface contact with the photoconductive layer through a portion of its path of movement, a transfer means for transferring the developed image from the photoconductive layer to the web surface while the photoconductive layer and the web are in surface contact, a fixing means for fixing the developed image on the web surface, a means for applying an aqueous solution to the surface of the web, a means for applying lithographic ink to the fixed powder image on the web surface, a feeding means for feeding print receiving material into surface contact with the inked surface of the web, and a means for pressing the print-receiving material into intimate surface contact with the inked powder image on the web surface.

Further, U.S. Pat. No. 3,526,191 (Silverberg et al.) discloses a duplicating process wherein magnetic images of copy to be reproduced are created and used to attract magnetically attractable powder to form subsequent reproductions of the original copy. The magnetic images are deposited and fused to a sheet to form a master. The magnetic field extending from the master can be used to either attract magnetic toner directly to the fused image on the master with subsequent transfer to a copy sheet or the field can extend through a copy sheet placed over the master to attract magnetic toner to the copy sheet in the pattern of the master image. The toner images are then fused to the copy sheet. Mirror images can be avoided by transferring the toner images to intermediate surfaces or by producing the master in a reverse reading form.

Additionally, U.S. Pat. No. 3,804,511 (Rait et al.) and U.S. Pat. No. 3,993,484 (Rait et al.) disclose a process wherein an electrostatic image is formed on a surface and magnetic toner paticles are then applied to the surface and adhere thereto in correspondence with the electrostatic image. Portions of the same surface or another are surface are magnetized, as determined by the location of the toner particles, to form a magnetic image corresponding to the electrostatic image. The toner particles are then transferred by friction to a copy medium such as paper while the magnetic image is retained or stored on the surface. Toner particles can then again be applied to the magnetic image for production of additional copies.

"Color Xerography With Intermediate Transfer," J. R. Davidson, Xerox Disclosure Journal, volume 1, number 7, page 29 (July 1976), the disclosure of which is totally incorporated herein by reference, discloses a xerographic development apparatus for producing color images. Registration of the component colors is improved by the use of a dimensionally stable intermediate transfer member. Component colors such as cyan, yellow, magenta, and black are synchronously developed onto xerogaphic drums and transferred in registration onto the dimensionally stable intermediate transfer member. The composite color image is then transferred to a receiving surface such as paper. The intermediate transfer member is held in registration at the transfer station for transferring images from the xerographic drums to the member by a hole-and-sprocket arrangement, wherein sprockets on the edges of the drums engage holes in the edge of the intermediate transfer member.

Intermediate transfer elements employed in imaging apparatuses in which a developed image is first transferred from the imaging member to the intermediate and then transferred from the intermediate to a substrate should exhibit both good transfer of the developer material from the imaging member to the intermediate and good transfer of the developer material from the intermediate to the substrate. Good transfer occurs when most of all of the developer material comprising the image is transferred and little residual developer remains on the surface from which the image was transferred. Good transfer is particularly important when the imaging process entails generating full color images by sequentially generating and developing images in each primary color in succession and superimposing the primary color images onto each other on the substrate, since undesirable shifting and variation in the final colors obtained can occur when the primary color images are not efficiently transferred to the substrate.

Although known processes and materials are suitable for their intended purposes, a need remains for imaging apparatuses and processes employing intermediate transfer elements with high transfer efficiency. In addition, there is a need for imaging apparatuses and processes employing intermediate transfer elements that enable generation of full color images with high color fidelity. Further, a need exists for imaging apparatuses and processes employing intermediate transfer elements that enable a simplified paper path through the apparatus. Additionally, a need remains for imaging apparatuses and processes employing intermediate transfer elements that enable high speed printing processes for the generation of images of more than one color. There is also a need for imaging apparatuses and processes employing intermediate transfer elements that enable simplified and improved registration of superimposed images of different colors on a single substrate sheet to form multicolor or blended color images.

SUMMARY OF THE INVENTION

It is an object of the present invention to provide imaging apparatuses and processes employing intermediate transfer elements with high transfer efficiency.

It is another object of the present invention to provide imaging apparatuses and processes employing intermediate transfer elements that enable generation of full color images with high color fidelity.

It is yet another object of the present invention to provide imaging apparatuses and processes employing intermediate transfer elements that enable a simplified paper path through the apparatus.

It is still another object of the present invention to provide imaging apparatuses and processes employing intermediate transfer elements that enable high speed printing processes for the generation of images of more than one color.

Another object of the present invention is to provide imaging apparatuses and processes employing intermediate transfer elements that enable simplified and improved registration of superimposed images of different colors on a single substrate sheet to form multicolor or blended color images.

These and other objects of the present invention are achieved by providing an imaging apparatus which comprises an imaging member, a means for generating an electrostatic latent image on the imaging member, a means for developing the latent image, an intermediate transfer element having a charge relaxation time of no more than about $2\times10^2$ seconds to which the developed image can be transferred from the imaging member, and a means for transferring the developed image from the intermediate transfer element to a substrate. Another embodiment of the present invention is directed to an imaging process which comprises generating an electrostatic latent image on an imaging member, developing the latent image, transferring the developed image to an intermediate transfer element having a charge relaxation time of no more than about $2\times10^2$ seconds, and transferring the developed image from the intermediate transfer element to a substrate.

DETAILED DESCRIPTION OF THE PREFERRED EMBODIMENTS

The apparatus and process of the present invention can employ any means for generating and developing the latent electrostatic image. For example, electrophotographic processes can be employed, wherein an image is formed on an imaging member by exposure of a photosensitive imaging member to light in an imagewise pattern. In addition, the image can be generated by ionographic processes, wherein the image is formed on a dielectric imaging member by applying a charge pattern to the imaging member in imagewise fashion.

Figure 1:
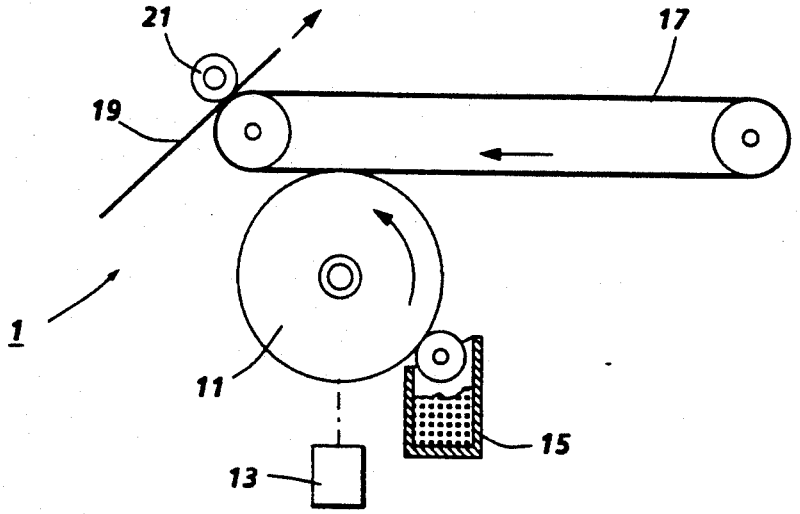
FIG. 1 illustrates schematically an imaging apparatus of the present invention comprising an imaging member, a means for generating an electrostatic latent image on the imaging member, a means for developing the latent image, an intermediate transfer element having a charge relaxation time of no more than about $2\times10^2$ seconds to which the developed image can be transferred from the imaging member, and an optional means for transferring the developed image from the intermediate transfer element to a substrate.

As illustrated schematically in FIG. 1, an apparatus of the present invention 1 includes imaging member 11, which can be any suitable imaging member for generating and/or retaining an electrostatic latent image, such as an electrophotographic photosensitive imaging member, an ionographic dielectric receiver imaging member, or the like. Imaging member 11 can have any suitable configuration, such as a drum, a strip, a sheet, an endless belt, or the like; as shown in FIG. 1, imaging member 11 is in drum configuration. An electrostatic latent image is formed on imaging member 11 by image generating means 13, which can be any suitable means for generating an image on the member. When the imaging member 11 is photosensitive, image generating means 13 can be any suitable means for exposing imaging member 11 to light in an imagewise fashion, such as an optical system for exposing the member to an original document, a laser writing system for forming a light pattern exposure on the member, or the like. When the imaging member 11 is an ionographic dielectric receiver, image generating means 13 can be any suitable means for generating an image pattern on the receiver, such as an ionographic writing head. The electrostatic latent image formed on imaging member 11 by image generating means 13 is then developed by developing means 15, which can be any suitable means for developing an electrostatic latent image, such as a developer housing containing a dry developer and a means of applying the developer to the imaging member, a bath of liquid developer, a developer housing containing a liquid developer and a means of applying the developer to the imaging member, or the like. Subsequent to development of the latent image, the developed image is transferred from imaging member 11 to intermediate transfer element 17. Intermediate transfer element 17 can have any suitable configuration, such as a drum, a strip, a sheet, an endless belt, or the like; as shown in FIG. 1, intermediate transfer element 17 is in endless belt configuration. The transfer element is of a material having a charge relaxation time of no more than about $2\times10^2$ seconds. Subsequent to transfer of the image from the imaging member 11 to intermediate transfer element 17, the developed image is transferred from intermediate transfer element 17 to substrate 19 by optional transfer means 21. Substrate 19 can be any suitable desired substrate, such as paper, transparency material, cloth, wood, or the like. Optional transfer means 21 can be any suitable means for effecting transfer of the developed image to the substrate, such as a bias transfer roller, a corotron, or the like. In the absence of transfer means 21, transfer can also be effected by other suitable processes, such as simple contact between intermediate and substrate, adhesive transfer, in which the substrate has adhesive characteristics with respect to the developer material, or the like.

Figure 2:
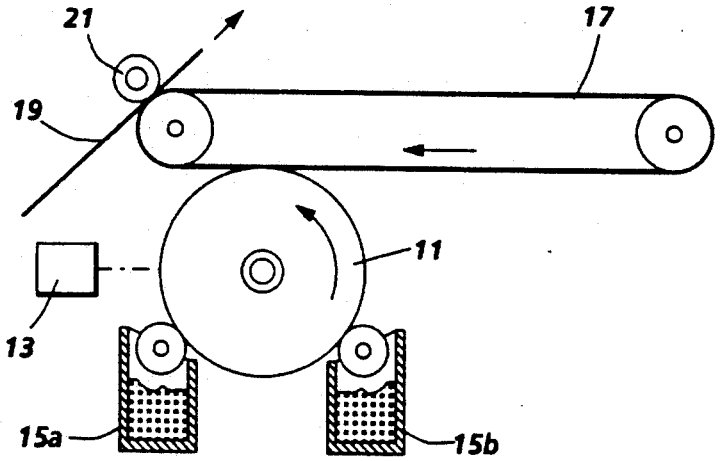
FIG. 2 illustrates schematically one imaging apparatus of the present invention suitable for preparing multicolored images.

When it is desired to produce images of two or more colors, the apparatus can include a plurality of developer housings, each containing a developer of a different color, as illustrated schematically in FIG. 2. In operation, the process then can entail generation of a first latent image on the imaging member 11, development of the first image by a first developing means 15*a* employing a first colored developer, generation of a second latent image on the imaging member 11, development of the second image by a second developing means 15*b* using a second colored developer (followed by repeating the generation and development steps as many times as desired), and transfer of the multi-colored image to the intermediate transfer element 17, followed by transfer of the multi-colored image from the intermediate transfer element 17 to the substrate 19. Alternatively, when the apparatus includes a single imaging member and a plurality of developer housings containing developers of different colors, the process can entail generation of a first latent image on the imaging member 11, development of the first image by a first developing means 15*a* employing a first colored developer, transfer of the first developed image to the intermediate transfer element 17, generation of a second latent image on the member, development of the second image by a second developing means 15*b* using a second colored developer, transfer of the second developed image to the intermediate transfer element 17 (followed by repeating the generation, development, and transfer steps as many times as desired), and subsequent transfer of the multi-colored image from the intermediate transfer element 17 to the substrate 19.

Figure 3:
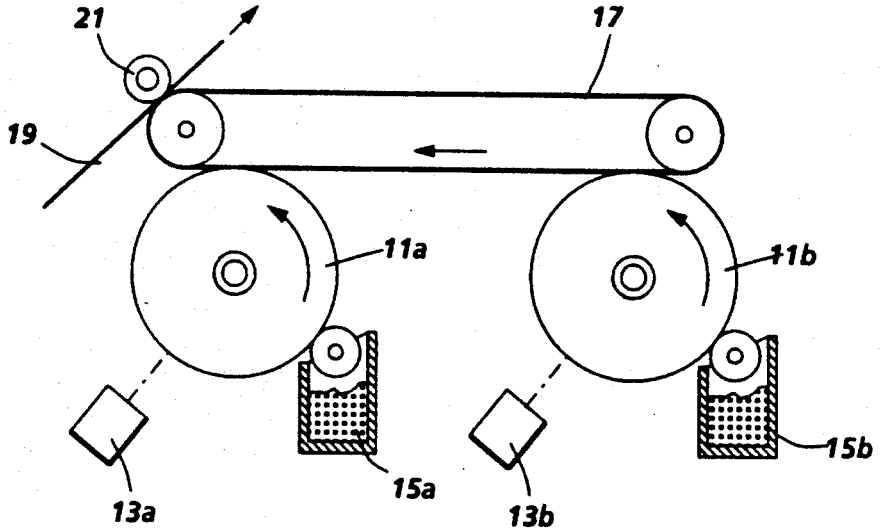
FIG. 3 illustrates schematically another imaging apparatus of the present invention suitable for preparing multi-colored images.

Alternatively, when it is desired to produce images of two or more colors, the apparatus can include two or more imaging members, each equipped with a developer housing containing a developer of a different color, as illustrated schematically in FIG. 3. In operation, the process then can entail generation of a first latent image on the first imaging member 11*a*, development of the first image by a first developing means 15*a* employing a first colored developer, transfer of the first developed image from the first imaging member 11*a* to the intermediate transfer element 17, generation of a second latent image on the second imaging member 11*b*, development of the second image by a second developing means 15*b* using a second colored developer, transfer of the second developed image from the second imaging member 11*b* to the intermediate transfer element 17 (followed by repeating the generation, development, and transfer steps as many times as desired), and subsequent transfer of the multi-colored image from the intermediate transfer element 17 to the substrate 19.

Any suitable developing processes and materials can be employed with the present invention. For example, dry development processes can be employed, either single component development processes in which the developer material consists essentially of toner particles, or two component development processes, wherein the developer material comprises toner particles and carrier particles. Typical toner particles can be of any composition suitable for development of electrostatic latent images, such as those comprising a resin and a colorant. Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they can be present in greater or lesser amounts, provided that the objectives of the invention are achieved.

Any suitable pigments or dyes or mixture thereof can be employed in the toner particles. Typical pigments or dyes include carbon black, nigrosine dye, aniline blue, magnetites, and mixtures thereof, with carbon black being a preferred colorant. The pigment is preferably present in an amount sufficient to render the toner composition highly colored to permit the formation of a clearly visible image on a recording member. Gererally, the pigment particles are present in amounts of from about 1 percent by weight to about 20 percent by weight based on the total weight of the toner composition; however, lesser or greater amounts of pigment particles can be present provided that the objectives of the present invention are achieved.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the Color index as Cl 60710, Cl Dispersed Red 15, a diazo dye identified in the Color index as Cl 26050, Cl Solvent Red 19, and the like. Illustrative examples of suitable cyan pigments include copper tetra-4-(octadecyl sulfonamido) phthalocyanine, X-copper phthalocyanine pigment, listed in the Color Index as Cl 74160, Cl Pigment Blue, and Anthradanthrene Blue, identified in the Color Index as Cl 69810, Special Blue X-2137, and the like. Illustrative examples of yellow pigments that can be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. These color pigments are generally present in an amount of from about 5 weight percent to about 20.5 weight percent based on the weight of the toner resin particles, although lesser or greater amounts can be present provided that the objectives of the present invention are met.

When the pigment particles are magnetites, which comprise a mixture of iron oxides ($Fe_3O_4$), such as those commercially available as Mapico Black, these pigments are present in the toner composition in an amount of from about 10 percent by weight to about 70 percent by weight, and preferably in an amount of from about 20 percent by weight to about 50 percent by weight, although they can be present in greater or lesser amounts, provided that the objectives of the invention are achieved.

The toner compositions can be prepared by any suitable method. For example, a method known as spray drying entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a pigmented resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size. A third suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size. Dry toner particles for two-component developers generally have an average particle size between about 6 micrometers and about 20 micrometers. Other similar blending methods may also be used. Subsequent to size classification of the toner particles, any external additives are blended with the toner particles. The resulting toner composition is then mixed with carrier particles such that the toner is present in an amount of about 1 to about 5 percent by weight of the carrier, and preferably about 3 percent by weight of the carrier, although different toner to carrier ratios are acceptable, provided that the objectives of the present invention are achieved.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a pigment, and an external additive can comprise 80 percent by weight of resin and 20 percent by weight of pigment; the amount of external additive present is reported in terms of its percent by weight of the combined resin and pigment. External additives can include any additives suitable for use in electrostatographic toners, including straight silica, colloidal silica (e.g. Aerosil R972®, available from Degussa, Inc.), ferric oxide, Unilin, polypropylene waxes, polymethylmethacrylate, zinc stearate, chromium oxide, aluminum oxide, stearic acid, polyvinylidene flouride (e.g. Kynar®, available from Pennwalt Chemicals Corporation), and the like. External additives can be present in any suitable amount, provided that the objectives of the present invention are achieved.

Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process. Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. The toner may be present, for example, in the two-component developer in an amount equal to about 1 to about 5 percent by weight of the carrier, and preferably is equal to about 3 percent by weight of the carrier.

Typical dry toners are disclosed in, for example, U.S. Pat. Nos. 2,788,288, 3,079,342, and U.S. Pat. No. Re. 25,136, the disclosures of each of which are totally incorporated herein by reference.

In addition, if desired, development can be effected with liquid developers. Liquid developers are disclosed, for example, in U.S. Pat. Nos. 2,890,174 and 2,899,335, the disclosures of each of which are totally incorporated herein by reference.

Any suitable conventional electrophotographic development technique can be utilized to deposit toner particles on the electrostatic latent image on the imaging member. Well known electrophotographic development techniques include magnetic brush development, cascade development, powder cloud development, electrophoretic development, and the like. Magnetic brush development is more fully described in, for example, U.S. Pat. No. 2,791,949, the disclosure of which is totally incorporated herein by reference; cascade development is more fully described in, for example, U.S. Pat. Nos. 2,618,551 and 2,618,552, the disclosures of each of which are totally incorporated herein by reference; powder cloud development is more fully described in, for example, U.S. Pat. Nos. 2,725,305, 2,918,910, and 3,015,305, the disclosures of each of which are totally incorporated herein by reference; and liquid development is more fully described in, for example, U.S. Pat. No. 3,084,043, the disclosure of which is totally incorporated herein by reference.

The transfer element employed for the present invention can be of any suitable configuration. Examples of suitable configurations include a sheet, a web, a foil, a strip, a coil, a cylinder, a drum, an endless belt, an endless mobius strip, a circular disc, or the like. Typically, the transfer element has a thickness of from about 2 to about 10 mils.

The transfer elements of the present invention have a charge relaxation time of no more than about $2\times10^2$ seconds to ensure efficient transfer from the intermediate to the substrate. The lower limit of suitable charge relaxation times is theoretically unlimited, and conductive materials such as metals can be employed as the transfer element. While not being limited by any theory, however, it is believed that the lower limit on the charge relaxation time for an intermediate transfer element in any given situation will be determined by the conductivity of the receiving substrate to which the toner image is ultimately transferred. Specifically, no shorting should occur between the intermediate transfer element and the substrate around the toner piles constituting the image, since shorting would result in little or no transfer field to effect transfer from the intermediate to the substrate. Typically, for transfer to paper, the charge relaxation time is from about $1\times10^{-3}$ seconds to about $2\times10^2$ seconds. The charge relaxation time ($\tau$) of a material is generally a function of the dielectric constant (K), the volume resistivity ($\rho$) of that material, and the permittivity of free space ($\epsilon_0$, a constant equal to $8.854\times10^{-14}$ farads per centimeter), wherein $\tau=K\epsilon_0\rho$. Examples of materials having suitable charge relaxation times include polyvinyl fluoride, such as Tedlar® available from E.I. Du Pont de Nemours & Company, polyvinyl fluoride loaded with conductive or dielectric fillers such as carbon particles, titanium dioxide, barium titanate, or any other filler capable of decreasing dielectric thickness, polyvinylidene fluoride, such as Kynar®, available from Pennwalt Corporation, polyvinylidene fluoride loaded with conductive or dielectric fillers such as carbon particles, titanium dioxide, barium titanate, or any other filler capable of decreasing dielectric thickness, paper, such as Xerox® 4024 paper or Xerox® Series 10 paper, and the like. In addition, metals can be employed as the intermediate transfer element material, such as aluminum, copper, brass, nickel, zinc, chromium, stainless steel, semitransparent aluminum, steel, cadmium, silver, gold, indium, tin, and the like. Metal oxides, including tin oxide, indium tin oxide, and the like, are also suitable. Any other material having the charge relaxation characteristics described herein can also be employed. Fillers employed to alter the relaxation time of a material may be present within that material in any amount necessary to effect the desired relaxation time; typically, fillers are present in amounts of from 0 to about 50 percent by weight. When paper or other materials for which conductivity is affected by relative humidity is used as the intermediate, the relative humidity may have to be controlled during the imaging process to maintain the intermediate transfer element at the desired charge relaxation time. In general, intermediate transfer elements of materials for which the charge relaxation time changes significantly with relative humidity perform optimally at relative humidities of 55 percent or less.

It is believed that other characteristics of the intermediate transfer element material such as surface energy, roughness, coefficient of friction, or the like are not significant factors in selecting an intermediate transfer element with high transfer efficiency. These characteristics, however, may be significant if a blade or other cleaner is employed to remove residual developer material from the intermediate transfer element, since it may be difficult to remove residual toner from the transfer element. Thus, although these characteristics are not significant when the transfer element is used only once, when it is desired to use the same transfer element more than once, the transfer element should also be selected so that it can be easily cleaned.

The developed image on the intermediate transfer element is subsequently transferred to a substrate. Preferably, prior to transfer the developed image on the intermediate is charged by, for example, exposure to a corotron to ensure that all of the toner particles are charged to the same polarity, thereby enhancing transfer efficiency by eliminating any wrong-sign toner. Wrong-sign toner is toner particles that have become charged to a polarity opposite to that of the majority of the toner particles and the same as the polarity of the latent image. Wrong-sign toner particles typically are difficult to transfer to a substrate. Examples of substrates include paper, transparency material such as polyester, polycarbonate, or the like, cloth, wood, or any other desired material upon which the finished image will be situated. If desired, the transferred developed image can thereafter be fused to the substrate by conventional means. Typical, well known electrophotographic fusing techniques include heated roll fusing, flash fusing, oven fusing, laminating, vapor fusing, adhesive spray fixing, and the like.

In the apparatus and process of the present invention, transfer of the developed image from the imaging member to the intermediate transfer element and transfer of the image from the intermediate transfer element to the substrate can be by any suitable technique conventionally used in electrophotography, such as corona transfer, pressure transfer, bias roll transfer, and the like. In the situation of transfer from the intermediate transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles.

A single wire corotron having applied thereto a potential of between about 5000 and about 8000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing members to the image receiving member. After transfer, a corona generator charges the receiving member to an opposite polarity to detack the receiving member from the member that originally bore the developed image, whereupon the image receiving member is separated from the member that originally bore the image.

Bias roll transfer is another method of effecting transfer of a developed image from one member to another. In this process, a biased transfer roller or belt rolls along the surface of the receiving member opposite to the surface that is to receive the developed image. Further information concerning bias roll transfer methods is disclosed in, for example, U.S. Pat. Nos. 2,807,233, 3,043,684, 3,267,840, 3,328,193, 3,598,580, 3,625,146, 3,630,591, 3,684,364, 3,691,993, 3,702,482, 3,781,105, 3,832,055, 3,847,478, 3,942,888, and 3,924,943, the disclosures of each of which are totally incorporated herein by reference.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Intermediate transfer elements comprising 8.5 by 11 inch sheets having a thickness of 4 mils (100 microns) of the materials indicated in the table below were prepared and passed through a Xerox® 6500 copier. Magenta images were generated by forming a latent image, developing the image with a negatively charged magenta toner, and transferring the magenta image to the intermediate. The toner mass of the developed image prior to transfer to the substrate was about 1.0 milligram per square centimeter. Prior to transfer, the developed image on the intermediate was charged negatively by a corotron to eliminate any wrong-sign toner. Transfer to the substrate was effected by placing the intermediate transfer element on a conductive ground plane, placing a piece of Xerox® Series 10 substrate paper in contact with the image on the intermediate, and passing the substrate paper and intermediate through a nip formed between the ground plane and a bias transfer roller. The bias transfer roller was obtained from a Xerox® 9200 copier, and comprised a 1 inch diameter aluminum tube coated with a ¼ inch coating of urethane doped to render the coating conductive, with the length (l) of the coated portion of the roller being 8 inches. During transfer, the intermediate transfer element and substrate passed through the bias transfer roller nip at a speed (v) of 4 inches per second, and a +5,6 microampere current (I) was passed through the bias transfer roller. Thus, the field during transfer, obtained by the expression $$E_T = \frac{1}{(v)(E_0)} \times \frac{I}{l}$$

(wherein $E_0 = 8.9 \times 10^{-12}$ farads per meter) was 30 volts per micron. The pressure in the transfer nip was about 0.5 pound per lineal inch. The table below indicates the dielectric constant (K), the volume resistivity ($\rho$), and the charge relaxation time ($\tau$) for each material tested and also indicates the percentage of toner transferred from the intermediate transfer element to the substrate for each material (% Trans.). All transfers were effected under relative humidity conditions of about 25 percent.

| Intermediate Material | % Trans. | $\tau$ | K | $\rho$ |
|---|---|---|---|---|
| Polyvinyl fluoride (Tedlar ®, loaded with 6 percent by weight carbon particles, E. I. Du Pont de Nemours & Company) | 98 | $10^{-3}$ | 8 | $10^{9}$ |
| Paper (Xerox ® Series 10, Xerox Corporation) | 97 | $3 \times 10^{-1}$ | 3.5 | $10^{12}$ |
| Paper (Xerox ® 4024 DP, Xerox Corporation) | 98 | $3 \times 10^{-1}$ | 3.5 | $10^{12}$ |
| Polyvinyl fluoride (Tedlar ®, E. I. Du Pont de Nemours & Company) | 97.5 | $3 \times 10^{1}$ | 8.5 | $4 \times 10^{13}$ |
| Polyvinyl fluoride (Tedlar ®, loaded with 10 percent by weight $TiO_2$ particles, E. I. Du Pont de Nemours & Company) | 98 | $8 \times 10^{1}$ | 11.0 | $7 \times 10^{13}$ |
| Polyvinylidene fluoride (Kynar ®, Pennwalt Corporation) | 98 | $1.6 \times 10^{2}$ | 8.4 | $2 \times 10^{14}$ |
| Nylon 12 (electrodeposited) | 87 | $4 \times 10^{2}$ | 3.8 | $10^{15}$ |
| Polyimide (Kapton ® HV, E. I. Du Pont de Nemours & Company) | 82 | $4 \times 10^{4}$ | 3.7 | $10^{17}$ |
| Polyeterafluoroethylene (Teflon ®, E. I. Du Pont de Nemours & Company) | 74 | $2 \times 10^{3}$ | 2.0 | $10^{16}$ |
| Polyether ether ketone (Victrex ® PEEK, ICI Americas Company) | 78 | $1 \times 10^{4}$ | 3.3 | $4 \times 10^{16}$ |
| Polyethylene terephthalate (Mylar ®, E. I. Du Pont de Nemours & Company) | 63 | $>10^{4}$ | 3.0 | $>10^{17}$ |
| Polysulfone (Thermalux ®, Westlake Plastics Company) | 54 | $1 \times 10^{4}$ | 3.0 | $5 \times 10^{16}$ |
| Polyethersulfone (Victrex ® PES, ICI Americas Company) | 60 | $>10^{4}$ | 3.5 | $5 \times 10^{18}$ |
| Polyetherimide (Ultrem ®, General Electric Company) | 63 | $2 \times 10^{5}$ | 3.1 | $7 \times 10^{17}$ |
| Polymethylpentane (TPX ®, Mitsui Petrochemical Industries) | 33 | $>10^{3}$ | 2.0 | $>10^{16}$ |

As the data indicate, the transfer elements formulated from materials having a charge relaxation time of $2 \times 10^2$ seconds or less exhibited excellent transfer efficiencies of over 95 percent. The Nylon 12 transfer element, with a charge relaxation time of $4 \times 10^2$ seconds, exhibited a significantly lower transfer efficiency of 87 percent, and the materials having higher charge relaxation times exhibited even lower transfer efficiencies ranging from 33 percent to 82 percent. Further, it can be seen that these improved transfer efficiency results are not a function of the smoothness or surface energy of the materials, since rough, high surface energy (40 dynes per square centimeter) materials such as paper exhibited excellent transfer efficiency, whereas very smooth, low surface energy materials such as Teflon ® (surface energy 19 dynes per square centimeter) exhibited relatively poor transfer efficiency.

EXAMPLE II

Intermediate transfer elements of the materials indicated in the table below comprising 8.5 by 11 inch sheets having a thickness of 4 mils (100 microns) were prepared and passed through a Xerox ®6500 copier. Images were generated by forming a latent image, developing the image with a negatively charged toner of either magenta, cyan, or yellow color, and transferring the image to the intermediate. The toner mass of the developed color image on each intermediate transfer element prior to transfer to the substrate was about 1.1 milligrams per square centimeter. Prior to transfer, the developed image on the intermediate was charged negatively by a corotron to eliminate any wrong-sign toner. Transfer to the substrate was effected by placing the intermediate transfer element on a conductive ground plane, placing a piece of Xerox ® Series 10 substrate paper in contact with the image on the intermediate, and passing the ground plane-intermediate-paper substrate sandwich under a transfer corotron charged at 5.5 kilovolts and +0.8 microamperes per inch at a speed of 4 inches per second. The table below indicates the dielectric constant (K), the volume resistivity ($\rho$), and the charge relaxation time ($\upsilon$) for each material tested and also indicates the percentage of toner transferred from the intermediate transfer element to the substrate for each material (% Trans.). All transfers were effected under relative humidity conditions of about 25 percent.

| Intermediate Material | % Trans. | $\tau$ | K | $\rho$ |
|---|---|---|---|---|
| Polyvinyl fluoride (Tedlar ®) | 91.1 | $3 \times 10^1$ | 8.5 | $4 \times 10^{13}$ |
| Polyvinyl fluoride (Tedlar ®, loaded with 10 percent by weight $TiO_2$ particles) | 91.1 | $8 \times 10^1$ | 11.0 | $7 \times 10^{13}$ |
| Polyvinyl fluoride (Tedlar ®, loaded with 6 percent by weight carbon particles) | 91.3 | $10^{-3}$ | 8.0 | $10^9$ |
| Polyethylene terephthalate (Mylar ®) | 86.3 | $>10^4$ | 3.0 | $>10^{17}$ |

As the data indicate, the transfer elements formulated from materials having a charge relaxation time constant of $2 \times 10^2$ seconds or less exhibited transfer efficiencies of over 90 percent. The Mylar ® transfer element, with a charge relaxation time of over 10,000 seconds, exhibited a lower transfer efficiency of 86.3 percent.

EXAMPLE III

An intermediate transfer element comprising an 8.5 by 11 inch sheet of polyvinyl fluoride (Tedlar ®) loaded with 10 percent by weight of $TiO_2$ ($\tau = 8 \times 10^1$) having a thickness of 4 mils (100 microns) was prepared and passed through a Xerox ® 6500 copier. Full color images were generated by forming a first latent image, developing the image with a negatively charged magenta toner, transferring the magenta image to the intermediate, forming a second latent image, developing the image with a negatively charged yellow toner, transferring the yellow image to the intermediate on top of the magenta image, forming a third latent image, developing the image with a negatively charged cyan toner, and transferring the cyan image to the intermediate on top of the magenta and yellow images. The toner mass of the developed full color image prior to transfer to the substrate was about 2.0 milligrams per square centimeter. Prior to transfer, the developed image on the intermediate was charged negatively by a corotron to eliminate any wrong-sign toner. Transfer to the substrate was effected by placing the intermediate transfer element on a conductive ground plane, placing a piece of Xerox ® Series 10 substrate paper in contact with the image on the intermediate, and passing the substrate paper and intermediate through a nip formed between the ground plane and a bias transfer roller. The bias transfer roller was obtained from a Xerox ® 9200 copier, and comprised a 1 inch diameter aluminum tube coated with a ¼ inch coating of urethane doped to render the coating conductive, with the length (l) of the coated portion of the roller being 8 inches. During transfer, the intermediate transfer element and substrate passed through the bias transfer roller nip at a speed of 4 inches per second, and a +5.6 microampere current was passed through the bias transfer roller, resulting in a field during transfer of 30 volts per micron. The pressure in the transfer nip was about 0.5 pound per lineal inch. Transfer was effected under relative humidity conditions of about 25 percent. The full color image was transferred to the paper substrate with a transfer efficiency of 97 to 98 percent.

EXAMPLE IV

The process of Example III was repeated except that an intermediate transfer element comprising polyvinyl fluoride (Tedlar ®) loaded with 6 percent by weight of carbon ($\tau = 10^{-3}$) was used instead of polyvinyl fluoride (Tedlar ®) loaded with 10 percent by weight of $TiO_2$. The full color image was transferred to the paper substrate with a transfer efficiency of 97 to 98 percent.

EXAMPLE V

An intermediate transfer element comprising an 8.5 by 11 inch sheet of polyvinyl fluoride (Tedlar ®) loaded with 10 percent by weight of $TiO_2$ ($\tau = 8 \times 10^1$) having a thickness of 4 mils (100 microns) was prepared and passed through a Canon ® CLC 1 full color copier. Full color images were generated by forming a first latent image, developing the image with a negatively charged magenta toner, transferring the magenta image to the intermediate, forming a second latent image, developing the image with a negatively charged cyan toner, transferring the cyan image to the intermediate on top of the magenta image, forming a third latent image, developing the image with a negatively charged yellow toner, transferring the yellow image to the intermediate on top of the magenta and cyan images, forming a fourth latent image, developing the image with a negatively charged black toner, and transferring the black image to the intermediate on top of the magenta, cyan, and yellow images. The toner mass of the developed full color image prior to transfer to the substrate was about 2.0 milligrams per square centimeter. Prior to transfer, the developed image on the intermediate was charged negatively by a corotron to eliminate any wrong-sign toner. Transfer to the substrate was effected by placing the intermediate transfer element on a conductive ground plane, placing a piece of Xerox ® Series 10 substrate paper in contact with the image on the intermediate, and passing the substrate paper and intermediate through a nip formed between the ground plane and a bias transfer roller. The bias transfer roller was obtained from a Xerox® 9200 copier, and comprised a 1 inch diameter aluminum tube coated with a ¼ inch coating of urethane doped to render the coating conductive, with the length (l) of the coated portion of the roller being 8 inches. During transfer, the intermediate transfer element and substrate passed through the bias transfer roller nip at a speed of 4 inches per second, and a +5.6 microampere current was passed through the bias transfer roller, resulting in a field during transfer of 30 volts per micron. The pressure in the transfer nip was about 0.5 pound per linear inch. Transfer was effected under relative humidity conditions of about 25 percent. The full color image was transferred to the paper substrate with a transfer efficiency of 96 to 97 percent.

EXAMPLE VI

The process of Example V was repeated except that an intermediate transfer element comprising polyvinyl fluoride (Tedlar®) loaded with 6 percent by weight of carbon ($\tau=10^{-3}$) was used instead of polyvinyl fluoride (Tedlar®) loaded with 10 percent by weight of $TiO_2$. The full color image was transferred to the paper substrate with a transfer efficiency of 96 to 97 percent.

EXAMPLE VII

An Intermediate transfer element comprising an 8.5 by 11 inch sheet of polyvinyl fluoride (Tedlar®) loaded with 10 percent by weight of $TiO_2$ ($\tau=8\times10^{1}$) having a thickness of 4 mils (100 microns) was prepared and passed through a Xerox® 1075 copier. Black images were generated by forming a latent image, developing the image with a positively charged black toner, and transferring the black image to the intermediate. The toner mass of the developed image prior to transfer to the substrate was about 1.0 milligram per square centimeter. Prior to transfer, the developed image on the intermediate was charged positively by a corotron to eliminate any wrong-sign toner. Transfer to the substrate was effected by placing the intermediate transfer element on a conductive ground plane, placing a piece of Xerox® Series 10 substrate paper in contact with the image on the intermediate, and passing the substrate paper and intermediate through a nip formed between the ground plane and a bias transfer roller. The bias transfer roller was obtained from a Xerox® 9200 copier, and comprised a 1 inch diameter aluminum tube coated with a ¼ inch coating of urethane doped to render the coating conductive, with the length (l) of the coated portion of the roller being 8 inches. During transfer, the intermediate transfer element and substrate passed through the bias transfer roller nip at a speed of 4 inches per second, and a −5.6 microampere current was passed through the bias transfer roller, resulting in a field during transfer of 30 volts per micron. The pressure in the transfer nip was about 0.5 pound per lineal inch. Transfer was effected under relative humidity conditions of about 25 percent. The full color image was transferred to the paper substrate with a transfer efficiency of 97 percent.

Other embodiments and modifications of the present invention may occur to those skilled in the art subsequent to a review of the information presented herein; these embodiments and modifications, as well as equivalents thereof, are also included within the scope of this invention.

We claim:

1. An imaging apparatus which comprises an imaging member, a means for generating an electrostatic latent image on the imaging member, a means for developing the latent image, an intermediate transfer element having a charge relaxation time of from about $3\times10^{-1}$ seconds to about $2\times10^{2}$ seconds and a volume resistivity of about $10^{12}$ ohm-cm or greater to which the developed image can be transferred from the imaging member, and a means for transferring the developed image from the intermediate transfer element to a substrate.

2. An imaging apparatus according to claim 1 wherein the imaging member is photosensitive and the means for generating an electrostatic latent image exposes the imaging member to light in imagewise fashion.

3. An imaging apparatus according to claim 1 wherein the imaging member is a dielectric and the means for generating an electrostatic latent image applies a charge pattern to the imaging member in imagewise fashion.

4. An imaging apparatus according to claim 1 wherein the means for developing the latent image employs a dry developer.

5. An imaging apparatus according to claim 1 wherein the means for transferring the image from the intermediate transfer element to a substrate is a corotron.

6. An imaging apparatus according to claim 1 wherein the means for transferring the image from the intermediate transfer element to a substrate is a bias transfer roller.

7. An imaging apparatus according to claim 1 wherein the intermediate transfer element and the substrate are selected so that no shorting occurs between the intermediate transfer element and the substrate during transfer of the image from the intermediate transfer element to the substrate.

8. An imaging apparatus which comprises an imaging member, a means for generating an electrostatic latent image on the imaging member, a means for developing the latent image, an intermediate transfer element having a charge relaxation time of no more than about $2\times10^{2}$ seconds and a volume resistivity of about $10^{12}$ ohm-cm or greater to which the developed image can be transferred from the imaging member, and a means for transferring the developed image from the intermediate transfer element to a substrate, wherein the intermediate transfer element is formulated from a material selected from the group consisting of polyvinyl fluoride, polyvinyl fluoride containing a filler material, polyvinylidene fluoride, polyvinylidene fluoride containing a filler material, and paper.

9. An imaging apparatus according to claim 8 wherein the filler material is selected from the group consisting of carbon, titanium dioxide, barium titanate, and mixtures thereof.

10. An imaging process which comprises generating an electrostatic latent image on an imaging member, developing the latent image, transferring the developed image to an intermediate transfer element having a charge relaxation time of from about $3\times10^{-1}$ seconds to about $2\times10^{2}$ seconds and a volume resistivity of about $10^{12}$ ohm-cm or greater, and transferring the developed image from the intermediate transfer element to a substrate.

11. An imaging process according to claim 10 wherein the imaging member is photosensitive and the means for generating an electrostatic latent image exposes the imaging member to light in imagewise fashion.

12. An imaging process according to claim 10 wherein the imaging member is a dielectric and the means for generating an electrostatic latent image applies to a charge pattern to the imaging member in imagewise fashion.

13. An imaging process according to claim 10 wherein the means for developing the latent image employs a dry developer.

14. An imaging process according to claim 10 wherein the means for transferring the image from the intermediate transfer element to a substrate is a corotron.

15. An imaging process according to claim 10 wherein the means for transferring the image from the intermediate transfer element to a substrate is a bias transfer roller.

16. An imaging process according to claim 10 wherein the intermediate transfer element and the substrate are selected so that no shorting occurs between the intermediate transfer element and the substrate during transfer of the image from the intermediate transfer element to the substrate.

17. An imaging process according to claim 10 wherein the developed image on the intermediate is charged to a single polarity prior to transfer to eliminate wrong-sign toner.

18. An imaging process which comprises generating an electrostatic latent image on an imaging member, developing the latent image, transferring the developed image to an intermediate transfer element having a charge relaxation time of no more than about $2\times10^2$ seconds and a volume resistivity of about $10^{12}$ ohm-cm or greater, and transferring the developed image from the intermediate transfer element to a substrate, wherein the intermediate transfer element is formulated from a material selected from the group consisting of polyvinyl fluoride, polyvinyl fluoride containing a filler material, polyvinylidene fluoride, polyvinylidene fluoride containing a filler material, and paper.

19. An imaging process according to claim 18 wherein the filler material is selected from the group consisting of carbon, titanium dioxide, and barium titanate.

20. An imaging apparatus which comprises an imaging member, a means for generating an electrostatic latent image on the imaging member, a means for developing the latent image, an intermediate transfer element having a charge relaxation time of no more than about $2\times10^2$ seconds and a volume resistivity of about $10^{12}$ ohm-cm or greater to which the developed image can be transferred from the imaging member, and a means for transferring the developed image from the intermediate transfer element to a substrate, wherein the intermediate transfer element is formulated from a material selected from the group consisting of polyvinyl fluoride, polyvinylidene fluoride, paper, and metal oxides.

21. An imaging apparatus which comprises an imaging member, a means for generating an electrostatic latent image on the imaging member, a means for developing the latent image, an intermediate transfer element having a charge relaxation time of no more than about $2\times10^2$ seconds and a volume resistivity of about $10^{12}$ ohm-cm or greater to which the developed image can be transferred from the imaging member, and a means for transferring the developed image from the intermediate transfer element to a substrate, wherein the intermediate transfer element is formulated from a material selected from the group consisting of (a) polyvinyl fluoride filled with a material selected from the group consisting of titanium dioxide and barium titanate and (b), polyvinylidene fluoride filled with a material selected from the group consisting of titanium dioxide and barium titanate.

22. An imaging process which comprises generating an electrostatic latent image on an imaging member, developing the latent image, transferring the developed image to an intermediate transfer element having a charge relaxation time of no more than about $2\times10^2$ seconds and a volume resistivity of about $10^{12}$ ohm-cm or greater, and transferring the developed image from the intermediate transfer element to a substrate, wherein the intermediate transfer element is formulated from a material selected from the group consisting of polyvinyl fluoride, polyvinylidene fluoride, paper, and metal oxides.

23. An imaging process which comprises generating an electrostatic latent image on an imaging member, developing the latent image, transferring the developed image to an intermediate transfer element having a charge relaxation time of no more than about $2\times10^2$ seconds and a volume resistivity of about $10^{12}$ ohm-cm or greater, and transferring the developed image from the intermediate transfer element to a substrate, wherein the intermediate transfer element is formulated from a material selected from the group consisting of (a) polyvinyl fluoride filled with a material selected from the group consisitng of titanium dioxide and barium titanate and (b), polyvinylidene fluoride filled with a material selected from the group consisting of titanium dioxide and barium titanate.

24. A process which comprises (a) providing an imaging apparatus which comprises an imaging member, a means for generating an electrostatic latent image on the imaging member, a means for developing the latent image, and a means for transferring the developed image from an intermediate transfer element to a substrate; (b) providing an intermediate transfer element to which the developed image can be transferred from the imaging member, said intermediate transfer element being selected to have a charge relaxation time of from about $3\times10^{-1}$ seconds to about $2\times10^2$ seconds and a volume resistivity of about $10^{12}$ ohm-cm or greater; (c) incorporating the selected intermediate transfer element into the imaging apparatus; (d) generating an electrostatic latent image on the imaging member; (e) developing the latent image; (f) transferring the developed image to the intermediate transfer element; and (g) transferring the developed image from the intermediate transfer element to a substrate.

25. An imaging apparatus which comprises an imaging member, a means for generating an electrostatic latent image on the imaging member, a means for developing the latent image, an intermediate transfer element having a charge relaxation time of no more than about $2\times10^2$ seconds and a volume resistivity of about $10^{12}$ ohm-cm or greater to which the developed image can be transferred from the imaging member, and a means for transferring the developed image from the intermediate transfer element to a substrate, wherein the intermediate transfer element is formulated of paper.

26. An imaging process which comprises generating an electrostatic latent image on an imaging member, developing the latent image, transferring the developed image to an intermediate transfer element having a charge relaxation time of no more than about $2\times10^2$ seconds and a volume resistivity of about $10^{12}$ ohm-cm or greater, and transferring the developed image from the intermediate transfer element to a substrate, wherein the intermediate transfer element is formulated of paper.

27. A process which comprises (a) providing an imaging apparatus which comprises an imaging member, a means for generating an electrostatic latent image on the imaging member, a means for developing the latent image, and a means for transferring the developed image from an intermediate transfer element to a substrate; (b) providing an intermediate transfer element to which the developed image can be transferred from the imaging member, said intermediate transfer element being selected to have a charge relaxation time of no more than about $2\times10^2$ seconds and a volume resistivity of about $10^{12}$ ohm-cm or greater; (c) incorporating the selected intermediate transfer element into the imaging apparatus; (d) generating an electrostatic latent image on the imaging member; (e) developing the latent image; (f) transferring the developed image to the intermediate transfer element; and (g) transferring the developed image from the intermediate transfer element to a substrate, wherein the intermediate transfer element is formulated of paper.

28. An imaging apparatus which comprises an imaging member, a means for generating an electrostatic latent image on the imaging member, a means for developing the latent image, an intermediate transfer element having a charge relaxation time of no more than about $2\times10^2$ seconds and a volume resistivity of about $10^{12}$ ohm-cm or greater to which the developed image can be transferred from the imaging member, and a means for transferring the developed image from the intermediate transfer element to a substrate, wherein the intermediate transfer element is formulated of a material selected from the group consisting of metal oxides.

29. An imaging process which comprises generating an electrostatic latent image on an imaging member, developing the latent image, transferring the developed image to an intermediate transfer element having a charge relaxation time of no more than about $2\times10^2$ seconds and a volume resistivity of about $10^{12}$ ohm-cm or greater, and transferring the developed image from the intermediate transfer element to a substrate, wherein the intermediate transfer element is formulated of a material selected from the group consisting of metal oxides.

30. A process which comprises (a) providing an imaging apparatus which comprises an imaging member, a means for generating an electrostatic latent image on the imaging member, a means for developing the latent image, and a means for transferring the developed image from an intermediate transfer element to a substrate; (b) providing an intermediate transfer element to which the developed image can be transferred from the imaging member, said intermediate transfer element being selected to have a charge relaxation time of no more than about $2\times10^2$ seconds and a volume resistivity of about $10^{12}$ ohm-cm or greater; (c) incorporating the selected intermediate transfer element into the imaging apparatus; (d) generating an electrostatic latent image on the imaging member; (e) developing the latent image; (f) transferring the developed image to the intermediate transfer element; and (g) transferring the developed image from the intermediate transfer element to a substrate, wherein the intermediate transfer element is formulated of a material selected from the group consisting of metal oxides.

* * * * *